United States Patent [19]

Garris et al.

[11] Patent Number: 4,813,333

[45] **Date of Patent: * Mar. 21, 1989**

[54] DUALLY-ADJUSTABLE FIREARM MUZZLE ATTACHMENT DEVICE

[75] Inventors: Sidney J. Garris, Albuquerque; Ancel U. Conner, Grants; Gerald Goodman, Albuquerque, all of N. Mex.

[73] Assignee: Accura Technology Corporation, Albuquerque, N. Mex.

[ * ] Notice: The portion of the term of this patent subsequent to Jan. 13, 2004 has been disclaimed.

[21] Appl. No.: 111,367

[22] Filed: Oct. 20, 1987

Related U.S. Application Data

[63] Continuation-in-part of Ser. No. 2,498, Jan. 12, 1987, which is a continuation-in-part of Ser. No. 750,074, Jun. 28, 1985, Pat. No. 4,635,528, which is a continuation-in-part of Ser. No. 560,574, Dec. 12, 1983, abandoned.

[51] Int. Cl.[4] ..... F41C 21/18

[52] U.S. Cl. ..... 89/14.3

[58] Field of Search ..... 42/75.02, 79; 89/14.2, 89/14.3, 14.4, 14.5

[56] References Cited

U.S. PATENT DOCUMENTS

| | | | |
|---|---|---|---|
| 1,636,357 | 7/1927 | Cutts, Jr. . | |
| 2,340,821 | 2/1944 | Russell . | |
| 2,796,005 | 6/1957 | Shapel . | |
| 3,187,633 | 6/1965 | Tanabe . | |
| 3,971,285 | 7/1976 | Ellis et al. | 89/14.3 |
| 4,057,003 | 11/1977 | Atchisson | 89/138 |
| 4,635,528 | 1/1987 | McQueen | 89/14.3 |

*Primary Examiner*—Deborah L. Kyle
*Assistant Examiner*—Richard Klein
*Attorney, Agent, or Firm*—Deborah A. Peacock; Robert W. Weig

[57] ABSTRACT

A dually-adjustable device for firearms is provided which is attached to the muzzle of a firearm to stabilize the muzzle and to suppress the flash during firing. The device is dually adjustable to counter both the magnitude and direction of firing forces. The device is further adjustable to individual firing characteristics as well as varying powder loads in ammunition. The device includes a cylindrical-shaped main body with at least one surface opening. One end of the main body attaches to the muzzle; the main body can be rotated about the longitudinal axis of the muzzle. The device further includes a cap with a gas-restricting opening which attaches to the other end of the main body. This gas-restricting opening in the cap causes a portion of firing gases to back up and flow through the surface opening thereby causing force in the direction of the opening which serves to stabilize the muzzle. A preferred cap comprises a frustum-shaped portion which narrows towards the firearm. The frustum portion increases the stabilizing effects of the device and suppresses muzzle flash. The cap is adjustable longitudinally, i.e., inward and outward, across the surface openings, to control the gas flow through the surface opening and thus the magnitude of the stabilizing force. Rotation of the main body and thereby the circumferential disposition of the surface opening controls the direction of the stabilizing forces. Indicia are disposed on the main body so a user can rotatably adjust the position of the surface opening for left and right-handed firers. Too, indicia are provided on the cap to assist a user in locating or relocating a desired or previously used cap position. The device is readily adjustable in the field or on the firing range without carrying spare parts or replacement items.

27 Claims, 3 Drawing Sheets

DUALLY-ADJUSTABLE FIREARM MUZZLE ATTACHMENT DEVICE

CROSS REFERENCE TO A RELATED APPLICATION

This application is a continuation-in-part application of U.S. patent application Ser. No. 002,498, entitled ADJUSTABLE FIREARM DEVICE, filed on Jan. 12, 1987, which is a continuation-in-part application of U.S. Ser. No. 750,074 filed 6/28/85, now U.S. Pat. No. 4,635,528, entitled AN ADJUSTABLE FIREARM STABILIZER, issued on Jan. 13, 1987, which is a continuation-in-part application of U.S. Ser. No. 560,574, entitled AN ADJUSTABLE FIREARM STABILIZER, filed on Dec. 12, 1983, and now abandoned, the teachings of which are incorporated herein by reference.

BACKGROUND OF THE INVENTION

1. Field of the Invention

This invention relates generally to muzzle devices for firearms, and more particularly to dually adjustable, personalized stabilizers and flash suppressors for firearms.

2. Description of the Prior Art

Muzzle brakes for firearms have been utilized for many years and many are well known. Probably one of the best known muzzle brakes is the Cutts Compensator which came into relatively wide use around 1930. The Cutts Compensator is described in U.S. Pat. No. 1,636,357, entitled ANTICLIMBING DEVICE, to Cutts and, as shown in this patent, comprises a body having a set of parallel anti-climbing slots through which escaping gases are forced by the pressure in the body. The Cutts anti-climbing slots are all parallel and are shown slanted toward the rear of the weapon and thus toward the firer. Additional sets of opposing laterally disposed parallel slots which also slant towards the firer provide anti-recoil gas ejectment forces. The Cutts patent teaches rotatable adjustment to control the direction of the escaping gas force solely to obtain traversing fire. There are several distinct disadvantages to the Cutts device. Significantly, because of the rearward slanting of the slots, the escaping gases tend to blast towards and around the face and hands of the firer. Too, the volume of gases escaping through the slots is not adjustable and can only be controlled by manufacturing bodies of varying sizes and containing different numbers and sizes of slots. Additionally, the cylindrical embodiment, as taught by Cutts in his FIG. 7, is limited to use with low powered guns and short bullets and must be longer than the preferred, tapered embodiment of his FIGS. 1 and 4.

A more recent muzzle attachment is disclosed in U.S. Pat. No. 4,392,413, entitled MUZZLE ATTACHMENT FOR A FIREARM, to Gwinn, in which two lateral opposing slots slant away from the firer. The Gwinn device contains two chambers; gases are trapped and then vented after they have built up to a particular pressure. U.S. Pat. No. 3,187,633, entitled CONTRA-JET MUZZLE BRAKE FOR FIREARMS, to Tanabe, teaches a muzzle brake having both circumferentially disposed slots, providing turbulence-producing, intersecting gas jets, and an explosion gas-trapping annular chamber, for reducing gas ejectment forces. The muzzle brake of Tanabe is intended to symmetrically and uniformly reduce muzzle blast effects and gas ejectment forces. U.S. Pat. No. 2,796,005, entitled RIFLE CONTROL TUBE, to Shapel, shows a muzzle brake having a pair of concentric inner and outer cylinders. A set of strategically located, parallel, slanted slots are positioned on top of the outer cylinder. This patent teaches that perpendicular slots produce undesirable "muzzle crack." The device of Shapel is not adjustable, is limited to parallel slanted slots and is manufactured in at least two pieces as an expensive two-concentric cylinder structure.

Although anti-climbing and anti-recoil devices are part of an old and well developed art, none of these muzzle attachment devices is readily adjustable in the field for individual user preferences or changes in ammunition used for amount and direction of gas ejectment. Too, none provides any indicia or other means of indicating an adjustment position, or that a selected or previously determined setting has been obtained.

Other patents typify developments in the field of muzzle attachments to firearms. U.S. Pat. No. 2,110,165, entitled MACHINE GUN, to Moore, teaches a type of muzzle device for machine guns that enhances the rearward recoil in order to compensate for a massive bolt and barrel arrangement. The Moore patent discloses a plug which is inserted into the end of a barrel of a weapon, allowing escaping gases to impinge thereon. This device enhances the recoil rather than diminishing or controlling the effects of recoil. U.S. Pat. No. 2,340,821, entitled SHOT SPREADING DEVICE, to Russell, discloses an extension of the barrel inside of an attached compensator to provide rifling for shotguns. The Russell device spreads the shot pattern after the shot wad leaves the muzzle by imparting a rotary motion to the shot wad. This device can be slightly separated from the muzzle, but allows only a limited lateral expansion of gases.

SUMMARY OF THE INVENTION

This invention relates to an improved, dually-adjustable firearm muzzle attachment device, for stabilizing and suppressing flash of a firearm, which can be adjusted to accommodate varying firers and ammunition. This device is an improvement over and overcomes the problems of the prior art in that multiple adjustments are possible, resulting in an improved stabilizing effect. The preferred device of the invention acts as a flash suppressor as well as a stabilizer.

When a firearm is fired, the muzzle tends to climb. This tendency to climb is a complex result of the recoil forces created by the firearm, ammunition, and the reaction of the firer to those forces. Thus, each firer will experience a different and unique amount of muzzle movement, because the firer's psychological and physical responses are unique. The device of the invention controls the firing forces so that firing accuracy can be achieved.

The dually-adjustable firearm muzzle attachment device of the invention, which is attachable to a bore-containing firearm, comprises a hollow main body having a longitudinal axis, an interior surface and an exterior surface, the main body comprising a muzzle attachment end and a cap attachment end and at least one surface opening communicating from the interior surface through the exterior surface; main body to muzzle attachment means for attaching the muzzle attachment end of the main body to a muzzle of a firearm; main body rotational adjustment means for rotatably adjusting the main body on the firearm to selectively position the surface opening to thereby control gas ejectment direction; a hollow cap comprising a longitudinal axis and a bullet-passing, gas-restricting outlet having an opening which is the same as or slightly larger than the bore of the firearm, the longitudinal axis of the cap and the longitudinal axis of the main body being superposed when the cap is in position on the main body; cap to main body attachment means for attaching the cap to the cap attachment end of the main body; and cap position adjustment means for adjusting the longitudinal position of the cap on the main body to thereby adjust the amount of gas ejected from the firearm when fired; whereby rotational position of the main body controls gas ejection direction and longitudinal cap position controls the amount and force of gas ejected, thereby providing dual adjustability to aid in firearm muzzle stability.

The main body of the muzzle attachment device of the invention is preferably generally cylindrical in shape. Preferably, the device of the invention comprises at least two surface openings wherein at least one surface opening is perpendicular to the longitudinal axis of the main body and at least one surface opening is at a slant to the longitudinal axis of the main body. The slanted surface opening is preferably pointed to direct escaping gases away from a firer of the firearm. Preferably, at least one perpendicular surface opening and at least one slanted surface opening are juxtaposed longitudinally on the main body and the perpendicular opening is disposed nearer the cap attachment end than the slanted opening.

The muzzle attachment device of the invention may further comprise tool receiving means for positioning the main body on a muzzle. The preferred tool receiving means are wrench flats.

The preferred main body to muzzle attachment means comprises means for threadably attaching the main body to an appropriately threaded muzzle.

The preferred main body rotational adjustment means comprises a spur and clip. An alternative main body rotational adjustment means comprises a star washer and lock nut.

The main body rotational adjustment means preferably further comprises main body locking means for locking the main body into a preselected rotational position on the muzzle of the firearm.

In the preferred embodiment of the invention, the dually-adjustable attachment device further comprises indicia circumferentially positioned on a user-visible portion of the main body for indicating the rotational position of the main body relative to the muzzle. Preferred indicia on the main body includes a mark for adjustment of the main body for a left-handed firer and a mark for adjustment of the main body for a right-handed firer.

The cap of the device of the invention is preferably substantially cylindrical in shape and comprises a frustum portion facing into the main body, the frustum portion providing flash suppression as well as muzzle stabilization. The frustum portion is preferably positionable to control gas flow out of at least one surface opening.

The cap of the device of the invention may further comprise an exit opening disposed on the cap adjacent but spaced from the gas-restricting outlet on the cap, the exit opening being positioned to pass a bullet fired from the firearm after it passes through the bullet-passing, gas-restricting outlet. The exit opening is preferably configured to fit a tool whereby the cap may be rotated by a tool fitting the configured exit opening to thereby longitudinally adjust the position of the cap on the main body.

The dually-adjustable muzzle attachment device of the invention preferably further comprises means for retaining the cap at an adjusted position on the main body. Preferably, the cap retaining means provides a plurality of discrete adjustment positions. The preferred cap retaining means comprises detent engagement surfaces circumferentially positioned about the cap, and detent means for engaging the detent engagement surfaces.

The cap of the device of the invention preferably comprises indicia circumferentially positioned on a user-visible portion of the cap for indicating the position of the cap relative to the main body. These indicia preferably correspond to detent engagement surfaces circumferentially positioned about the cap.

In the preferred embodiment, the cap to main body attachment means comprises means for threadably attaching the cap to the main body and the cap position adjustment means comprises means for threadably longitudinally adjusting the position of the cap on the main body. The preferred cap position adjustment means comprises means for longitudinally positioning the cap with reference to the main body to cover at least one surface opening a preselected amount to thereby control gas ejectment therefrom.

Use of the dually-adjustable device of the invention results in improved firing accuracy. The main body of the device can be adjusted with respect to the muzzle to control the direction of forces and the cap can be adjusted with respect to the main body to control the magnitude of forces.

It is a primary object of the present invention to provide a firearm stabilizing device with dual adjustment capability such that the magnitude and direction of the firing forces can be controlled to individually suit different firers.

It is another object of the present invention to provide a firearm stabilizing device which is easily dually adjustable in the field to individual firers and to varying types of ammunition.

Yet another object of the present invention is to provide a firearm flash suppressing device which reduces the flash from firing gases.

Still another object of the present invention is to provide indicia on an adjustable firearm muzzle attachment device to provide an indication of position when a desired setting is achieved and to indicate when a predetermined or preselected position is obtained.

One advantage of the present invention is that in accordance therewith, the amount and direction of muzzle anti-climbing force can each separately be readily adjusted in the field to suit different individuals using a firearm.

Another advantage of the present invention is that a device in accordance therewith can be easily reset to previously determined positions.

Still another advantage in practicing the present invention is that indicia can be used to aid in obtaining and recalling desired adjustments.

Other objects, advantages and novel features, and further scope of applicability of the present invention will be set forth in part in the detailed description to follow, taken in conjunction with the accompanying drawing, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWING

The accompanying drawing, which is incorporated into and forms a part of the specification, illustrates several embodiments of the present invention and, together with the description, serves to explain the principles of the invention.

DESCRIPTION OF THE PREFERRED EMBODIMENT

This invention relates to a dually-adjustable device for attachment to the muzzle of a firearm. The device comprises a main body and an adjustable cap which attaches to one end of the main body. The other end of the main body attaches to a muzzle on a firearm and is adjustable relative to the muzzle. The main body of the device comprises at least one surface opening through which firing gases escape. A gas-restricting opening in the cap restricts the flow of firing gases, causing them to back up and exit the surface opening in the main body. The volume of gases exiting the surface opening is adjustable by moving the cap so that varying portions of the surface opening can be restricted. The positioning of the surface opening with respect to the muzzle, and thus the direction the gases exit, is also adjustable to an individual firer.

Figure 1:
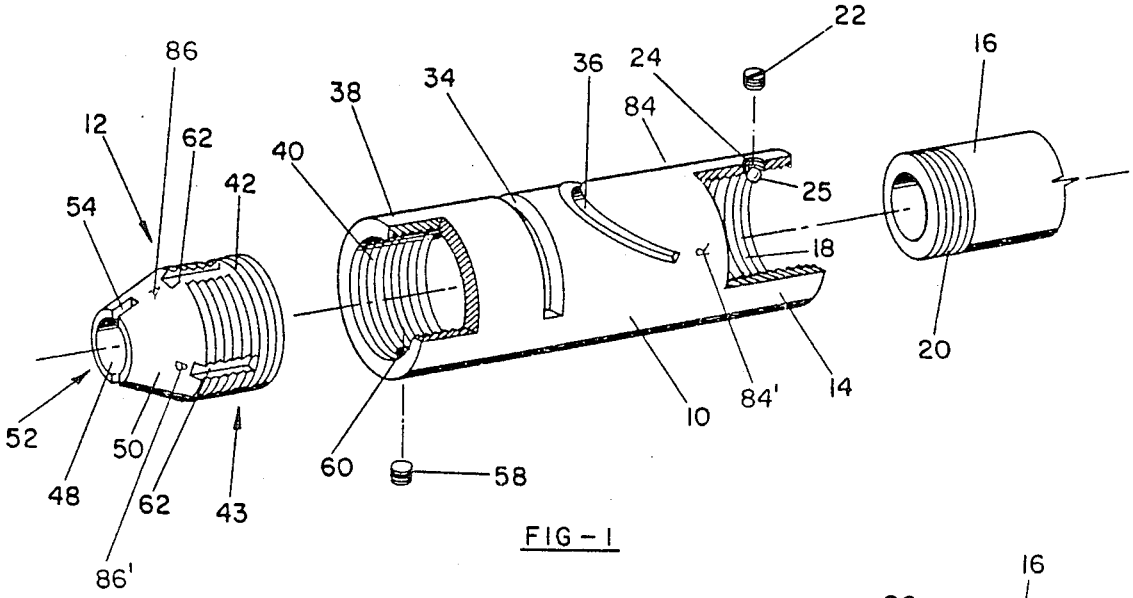
FIG. 1 of the drawing is an exploded isometric cutaway view of the invention showing an outward facing cap and various adjustment and locking means.
Figure 2:
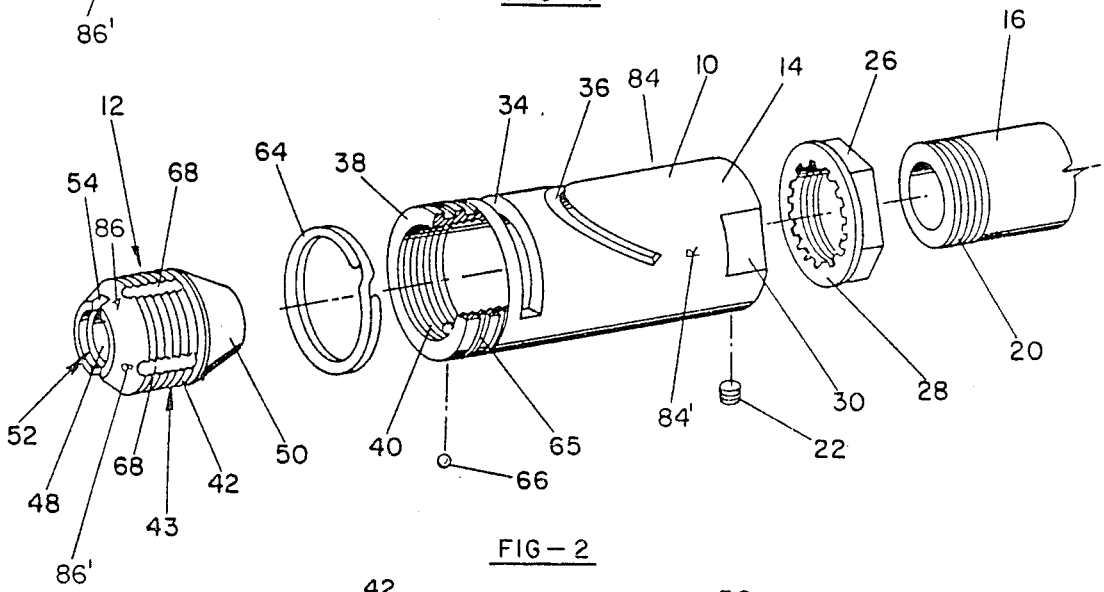
FIG. 2 of the drawing is an exploded isometric cutaway view of an alternative embodiment of the invention showing an inward facing cap and alternative locking means.
Figure 3:
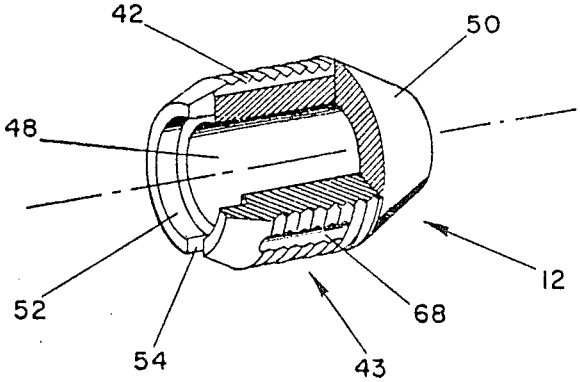
FIG. 3 of the drawing is an enlarged isometric cutaway view of the cap of FIG. 2 showing an exit opening and the gas-restricting opening as a counterbore.

FIGS. 1, 2, 4 and 5 of the drawing illustrate alternative embodiments of the device of the invention. FIG. 3 of the drawing is an enlarged view of the cap of FIG. 2. The device comprises a hollow main body 10 and a cap 12 having longitudinal axes. To better aid in description, the end of the main body 10 which attaches to a firearm muzzle 16 is referred to as the "muzzle attachment end" 14, and the opposite end of the main body 10 which attaches to the cap 12 is referred to as the "cap attachment end" 38 Preferably, the main body is generally cylindrical shaped. The main body muzzle attachment end 14 attaches to a firearm muzzle 16 by attachment means, such as threads 18 on the inside of the main body muzzle attachment end 14 (see FIG. 1). Most firearms have a cylindrical-shaped muzzle 16 with external threads 20 for attaching various attachments. This attachment can be removed from the muzzle 16 so that the device of the invention can be screwed on or attached to the muzzle 16. Thus, a particular device of the invention for a specific firearm preferably has a main body 10 with an inside diameter and threads 18 which correspond to the outside diameter and threads 20 for that specific firearm muzzle 16. For a firearm which does not have standard exterior threads, threads are preferably machined on the exterior of the barrel in order to attach the device of the invention.

Preferably, the main body 10 of the device of the invention is attached on the muzzle 16 for an individual firer by main body to muzzle attachment means and then adjusted in this position by main body rotational adjustment means. For individual firers, it is important to be able to rotate the main body 10 so that the forces caused by exiting gases can be directed in any direction. FIGS. 1, 2, 4 and 5 illustrate various main body to muzzle attachment means and main body rotational adjustment means. When threads 18 are utilized as the main body to muzzle attachment means, such as shown in FIGS. 1, 2, 4 and 5 these threads 18 may also serve as main body rotational adjustment means for rotating the main body 10 into an optimum position.

Figure 4:
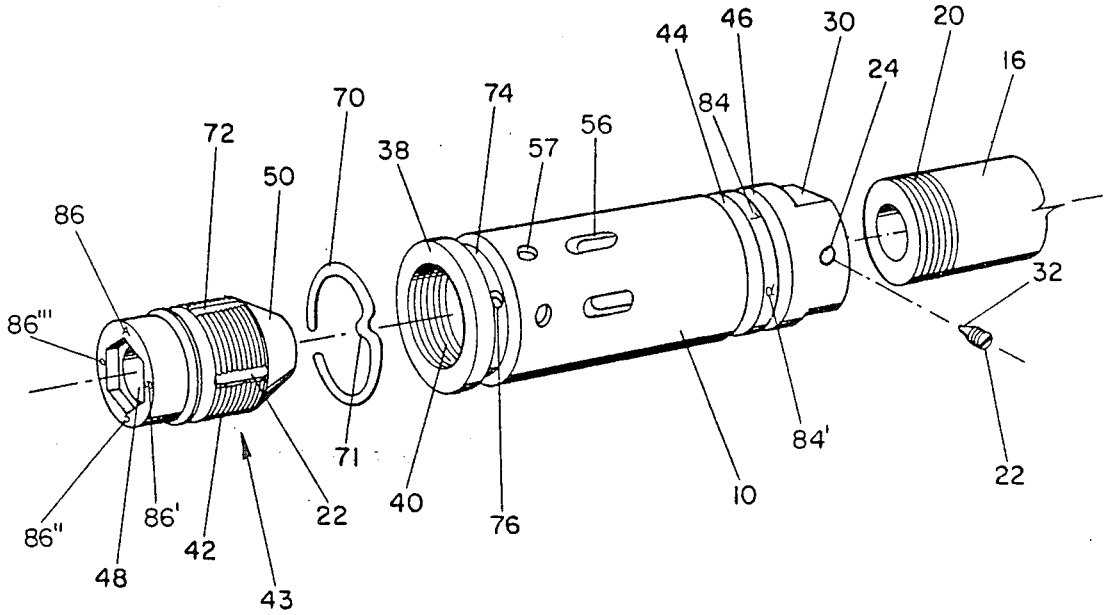
FIG. 4 of the drawing is an exploded isometric view of an alternative embodiment of the invention showing an alternative cap design, alternative surface openings and alternative locking means.
Figure 5:
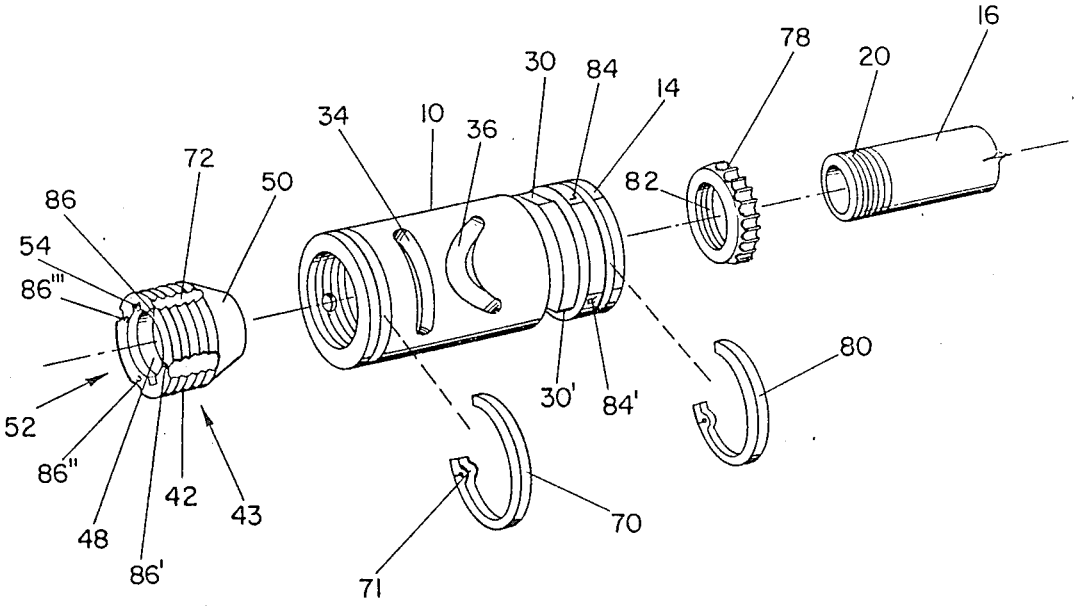
FIG. 5 of the drawing is an exploded isometric view of the preferred embodiment of the invention showing indicia and a spur and clip locking means.

The device of the invention preferably further comprises main body locking means for locking the main body 10 into a preselected position relative to the muzzle 16. FIGS. 1, 2 and 4 show a set screw 22 as main body locking means which passes through a perpendicular hole or opening 24 in the main body 10 and engages directly with the muzzle threads 20, or with a lead pellet 25 which conforms to the muzzle threads 20 (see FIG. 1), to hold the device in place after it has been adjusted. FIG. 4 shows the preferred set screw 22 for use with the device; this set screw 22 has a brass tip or nylon tip 32. This soft tip 32, as the lead pellet 25 shown in FIG. 1, presses against and conforms to the muzzle threads 20 without marring the muzzle threads 20. FIG. 2 further shows main body rotational adjustment and locking means in which two wrenches may be utilized. A nut 26 is screwed onto the muzzle threads 20. Preferably, a washer 28, such as a star washer as shown in FIG. 2, is placed between the nut 26 and the main body muzzle attachment end 14. The exterior of the main body muzzle attachment end 14 has several flat portions 30 for a wrench to grip. (These flat portions 30 are also illustrated in FIGS. 4 and 5.) One wrench is placed on the flat portions 30 and another wrench is placed on the nut 26 to fix the position of the main body 10 relative to the muzzle 16. FIG. 5, the preferred embodiment, illustrates a spur 78 and detent clip 80 which serve as main body to muzzle attachment means, main body rotational adjustment means and main body locking means. The spur 78 fits within the main body muzzle attachment end 14 and is held by the detent clip 80. Threads 82 on the inside of the spur 78 attach to threads 20 on the muzzle 16. The spur 78 enables the main body 10 to be rotated by merely twisting the main body 10, while the clip 80 keeps the main body 10 in a preselected position after twisting. The main body 10 may be manufactured with several main body locking means such as shown in FIGS. 2, 4 and 5. This gives the firer a choice to use either or both main body locking means depending on the use of the firearm, the field situation, or personal preference. Although various main body locking means have been described, other main body locking means, such as a spring and ball bearing, a clip, or other locking means, common to the art, can be utilized with the invention.

The main body 10 of the device of the invention comprises at least one surface opening and preferably at least two surface openings, preferably juxtaposed longitudinally thereon, through which firing gases escape. FIGS. 1, 2 and 5 illustrate the preferred types of surface openings for the present invention; a perpendicular opening 34 and a slanted opening 36. The perpendicular opening 34 is cut generally perpendicular to the longitudinal axis of the main body 10. If there are more than one perpendicular opening 34, they are preferably positioned next to each other. The slanted opening 36 is preferably cut through the main body 10 at a slant to the longitudinal axis of the main body so that gases exit away from the firer. If there are more than one slanted opening 36, they are preferably positioned next to each other. Preferably, when both perpendicular and slanted openings are utilized with the device, the perpendicular opening or openings 34 are placed closer to the cap attachment end 38 of the main body 10 than the slanted opening or openings 36. FIG. 4 illustrates alternative types of surface openings, circular openings 57 and longitudinal surface openings 56. Other types of surface openings may also be utilized in accordance with the device of the invention. The size, type, number, and placement of surface openings depend on the particular firearm and ammunition. Throughout the specification, the term "surface opening" used in the singular is used interchangeably with the term "surface openings" and is intended to mean both singular and multiple surface openings.

The adjustable cap 12 of the device of the invention attaches to the main body cap attachment end 38 by cap to main body attachment means, preferably by threads 40 on the inside of the main body cap attachment end 38 which correspond to threads 42 on the exterior of an attachment portion 43 of the cap 12, as shown in FIGS. 1–5. The cap 12 can attach to the exterior of the main body 10; however, it is preferable for the cap 12 to fit within the main body 10 so that the device has a smooth surface such as shown in FIGS. 1, 2, 4 and 5, and so that various attachments, such as a bayonet and grenade launcher, can be attached to the device. FIGS. 4 and 5 illustrate typical grooves 44 and 46 for such attachments. Grooves, like these, are generally present on a typical flash suppressor attachment.

The hollow cap 12 of the device of the invention comprises a longitudinal axis and has a generally circular bullet-passing, gas-restricting opening 48 which is sized to the same or slightly larger diameter as the bore diameter of the firearm. The longitudinal axis of the cap 12 and the longitudinal axis of the main body 10 are superposed when the cap 12 is in position on the main body 10. The gas-restricting opening 48 allows the bullet to exit, but causes some or most of the firing gases to back up and exit through the main body surface opening. An attachment portion 43 of the cap 12 forms a seal with the main body 10 so that gases will either exit through the surface opening of the main body 10 or through the gas-restricting opening 48 of the cap 12.

Preferably, the cap 12 of the device of the invention is generally cylindrical in shape and has a frustum cone portion 50, such as shown in FIGS. 1–5. Most preferably, the narrow portion of this frustum cone-shape 50 faces inward as shown in FIGS. 2–5. It has been found that with this inward facing embodiment, the flash from firing gases is suppressed. It is also believed that the inward facing frustum cone shape 50 causes a more effective stabilizing force.

Preferably, the cap 12 of the device of the invention comprises an exit opening 52 which is separate from the gas-restricting opening 48, as shown in FIGS. 2–5. This separate exit opening 52 can then be more effectively adapted to cap position adjustment means. The cap 12 may have a variety of shapes of exit openings 52; the exit opening is sized so that it is the same or larger than the gas-restricting opening 48. In such an embodiment the opening 48 is a counterbore, such as shown in FIGS. 2–5, so that the bullet exits from a smooth, circular hole. FIGS. 2, 3 and 5 illustrate a circular-shaped exit opening 52 and FIG. 4 illustrates a hexagonal-shaped exit opening 52. Other shapes of exit openings may also be utilized in accordance with the invention. These various shapes are discussed below.

The cap 12 of the device of the invention is attached to the main body 10 by cap to main body attachment means, preferably by screwing the main body attachment portion 43 onto or most preferably into the main body cap attachment end 38. Although the cap 12 can be manually screwed to a certain degree, various tools are generally necessary to aid or fine-tune the adjustment and positioning of the cap 12. Thus, the invention further preferably comprises cap position adjustment means. One tool which is readily available to a firer is a coin. FIGS. 1–3 and 5 illustrate one embodiment of the invention in which a coin slot 54 at the end of the exit opening 52 serves as cap position adjustment means. FIG. 1 is an example of the exit opening 52 acting as the gas-restricting opening 48. In such an embodiment, the coin slot 54, or other cap position adjustment means, must be carefully machined so as not to cause an unwanted effect on an exiting bullet. Thus, as mentioned previously, it is preferable to have an exit opening 52 which is separate from the gas-restricting opening 48. FIGS. 2, 3 and 5 also illustrate the use of a coin slot 54 as cap position adjustment means; however, the coin slot 54 is present at the exit opening 52 rather than at the gas-restricting opening 48, and will thus not interfere with an exiting bullet. FIG. 4 illustrates an alternative embodiment in which the exit opening 52 is hexagonal-shaped so that a hexagonal-shaped wrench, such as an Allen wrench, may be utilized to adjust the cap 12. Such an embodiment is useful, for example, when a supervised adjustment is desirable. Other cap position adjustment means, such as an outer hexagonal shape at the exit opening end which can be adjusted by a crescent wrench or a specialized key and socket arrangement could also be utilized as cap position adjustment means in accordance with the invention. This key could engage with the socket at the exit opening 52 or even on the interior of the gas-restricting opening 48. Several cap position adjustment means can be provided on the device so that various tools can be used depending on the field situation or personal preference. For example, the exit opening of the cap could have both a hexagonal opening and a coin slot.

Preferably, the cap 12 of the device of the invention is long enough so that at least one surface opening on the main body 10 can be partially or wholly covered or restricted by adjusting the cap 12 inward or outward. This type of variable adjustment allows the volume of gases exiting the main body surface opening(s) to be controlled. For example, if the cap 12 shown in FIGS. 1, 2 and 5 is screwed in fairly far, the cap 12 can wholly or partially cover the perpendicular opening 34 so that more gases are forced out the exit opening 52 and the slanted opening 36. FIG. 4 illustrates an elongated cap 12 which can more effectively block the circular surface openings 57 and the longitudinal surface openings 56. Such an adjustment is useful, for example, when ammunition is varied or to adjust to an individual firer's reactions.

Once the adjustment of the cap 12 on the main body 10 of the device of the invention is completed, it is preferable to fix or hold this adjustment in place. This is accomplished by cap retaining means. Some examples of cap retaining means are shown in the drawing. FIG. 1 illustrates a set screw 58 which passes through a perpendicular hole or opening 60 in the main body cap attachment end 38 and engages with the cap 12. Preferably, detent engagement surfaces such as longitudinal flat portions 62 are present on the exterior of the cap attachment portion 43 so that detent means, such as the set screw 58, can engage with the detent engagement surfaces (such as the flat longitudinal portions 62) and not mar the cap threads 42. As with the main body locking means, a lead pellet or a soft-tip set screw could also be utilized with the cap retaining means so as not to mar the threads, however, when frequent cap adjustments are desirable, detent engagement surfaces 62 on the cap attachment portion 43 are preferable. Any number of detent engagement surfaces 62 may be radially positioned on the exterior of the cap adjustment portion 43. A higher number of detent engagement surfaces 62 enables a higher-precision adjustment because shorter twists of the cap 12 are possible. FIG. 2 illustrates a detent spring 64 and ball bearing 66 arrangement as the cap retaining means. The spring 64 fits in a detent engagement radial groove or grooves 65 on the exterior surface of the main body cap attachment end 38. A hole (not shown) in this groove 65 enables the ball bearing 66 to engage with the cap 12. The ball bearing 66 preferably engages with at least one groove 68 on the cap attachment portion 43, rather than the cap threads 42, as the cap 12 is twisted. A greater number of grooves 68 allows a higher-precision adjustment. FIGS. 4 and 5 illustrate a clip 70 with a detent 71 as cap retaining means. The clip 70 fits within a detent engagement radial groove 74 on the exterior surface of the main body cap attachment end 38. A hole or opening 76 within this groove 74 enables the detent 71 to engage with grooves or flat portions 72 on the cap attachment portion 43. The detent 71 may be near the center of the clip 70 as shown in FIG. 4, near the edge of the clip 70 as shown in FIG. 5, or at any desired position. A clip and ball bearing arrangement, or other cap retaining means, common to the art, may also be utilized as cap retaining means in accordance with the invention.

In practicing the invention, detent positioning means are preferably utilized to provide a plurality of discrete main body and cap positions, as illustrated in FIGS. 1, 2, 4, and 5. Detent positioning means, such as the spur 78 and clip 80 in FIG. 5, can be used for retaining the rotatably positioned main body in a preselected position. The detent means and detent engagement surfaces for retaining the cap have been discussed in detail above. Detent devices are particularly advantageous in practicing the invention because cap and main body adjustments can readily be made in the field and the main body or cap is repositionable to a plurality of discrete positions.

The device of the invention preferably further comprises indicia for providing an indication of position of the main body and/or cap when desirable settings are achieved or when a predetermined or preselected position is obtained. The use of the term "indicia" throughout the specification and claims is intended to include singular and plural meanings. FIGS. 1, 2, 4 and 5 show indicia 84 and 84' on the main body 10 for indicating predetermined rotatable positions for the main body 10. The particular indicia 84 and 84' an "L" and a "R," indicate firing positions for a left-handed and right-handed firer, respectively. Cap indicia 86, 86', 86" and 86''' are shown in FIGS. 1, 2, 4 and 5 for indicating discrete positions of the cap 43 relative to the main body 10. These indicia 86, 86', 86" and 86''' are useful for positioning the cap 43 after an optimum position is found, depending on the firer, the firearm, the ammunition, etc. In the drawing, the cap indicia 86, 86', 86" and 86''' shown correspond to the detent engagement surfaces 62 (FIG. 1), 68 (FIG. 2) and 72 (FIGS. 4 and 5) on the cap 43.

During operation of the device of the invention, a bullet travels through the muzzle, into the hollow portion of the main body, through the gas-restricting opening of the cap, and out the exit opening of the cap. Because of the gas-restricting opening, most of the firing gases are forced out of the surface opening of the main body.

Normally, a muzzle will climb, especially during repeated automatic firings. Muzzle climb is caused primarily by reaction forces from a bullet being fired, acting on the human body of the firer. The human body is and acts like a flexible platform. Two distinct motions combine to cause muzzle climb. First, a weapon is generally fired from the firer's shoulder, waist, or some other freehand position, but almost invariably from one side of the firer and not directly in front of the firer's torso. This gives the weapon a moment arm, and the recoil forces acting through this moment arm cause a twisting of the firer's body about its vertical axis. The other motion is caused because the firer is usually standing on his/her feet and the recoil forces act through the firer's shoulder, waist, or arms. The torso is usually bent rearwards because of the firer's flexible back and legs. The firer may and probably will react, somewhat belatedly, to the impulse of the forces. Indeed, the likelihood that even an experienced firer can reactively compensate accurately for impulse type forces, and do so on a repetitive basis, is a function of extreme skill and proficiency which is seldom attained.

With the device of the invention and its dual-adjustment capability, the firer can determine the exact amount and direction of compensating forces required. The amount and direction of compensating forces vary with the weight, strength, and skill of the individual firer, as well as with the ammunition and firearm. With the dually-adjustable device of the invention, the gases exiting the surface opening of the main body (when the surface opening is near the top) tend to cause the muzzle to travel downward. The magnitude of this force is controlled by rotating the cap, and the precise direction of the force is controlled by rotating the main body. The device can thus be fine-tuned to individual firing conditions and firers.

Although the invention has been described with reference to these preferred embodiments, other embodiments can achieve the same results. Variations and modifications of the present invention will be obvious to those skilled in the art and it is intended to cover in the appended claims all such modifications and equivalents.

EXAMPLE 1

The muzzle movements of automatic M-16 and HK-91 firearms were tested with and without the dually-adjustable muzzle attachment device of the invention and with left- and right-handed firers. Each firer merely balanced the firearms on his/her palm of the non-trigger hand. It was found that without the device, the muzzles of both firearms climbed. With the device, the muzzles tended to remain in place, travel downwards, or travel only slightly upwards. The surface openings had to be rotated slightly to the left or right relative to the top of the muzzles depending on the firers' individual firing characteristics.

EXAMPLE 2

The flash of several firearms was tested, at night, with and without the dually-adjustable muzzle attachment device of the invention. A viewer stood to each side of the firearm during firing and compared the relative flashes produced. It was found that when the device having an inward facing frustum cone was attached to the firearms, substantially less flash was produced than when the firearms were fired without such a device.

We claim:

1. A dually adjustable firearm muzzle attachment device attachable to a bore-containing firearm, said device comprising:

a hollow main body having a longitudinal axis, an interior surface and an exterior surface, said main body comprising a muzzle attachment end and a cap attachment end and at least one surface opening communicating from said interior surface through said exterior surface;

main body to muzzle attachment means for attaching said muzzle attachment end of said main body to a muzzle of a firearm, when provided;

main body rotational adjustment means for rotatably adjusting said main body on the firearm to selectively position said surface opening to thereby control gas ejectment direction;

a hollow cap comprising a longitudinal axis, said hollow cap comprising a bullet-passing, gas-restricting outlet having an opening which is the same as or slightly larger than the bore of the firearm, when provided, said longitudinal axis of said cap and said longitudinal axis of said main body being superposed when said cap is in position on said main body;

cap to main body attachment means for attaching said cap to said cap attachment end of said main body; and cap position adjustment means for adjusting the longitudinal position of said cap on said main body to thereby adjust the amount of gas ejected from said at least one surface opening of the firearm when fired;

whereby rotational position of said main body controls gas ejection direction and longitudinal cap position controls the amount and force of gas ejected, thereby providing dual adjustability to aid in firearm muzzle stability.

2. The muzzle attachment device of claim 1 wherein said main body is generally cylindrical.

3. The muzzle attachment device of claim 1 wherein at least one said surface opening is perpendicular to said longitudinal axis of said main body.

4. The muzzle attachment device of claim 1 wherein at least one said surface opening is at a slant to said longitudinal axis of said main body.

5. The muzzle attachment device of claim 4 wherein said slanted surface opening is pointed to direct escaping gases away from a firer of the firearm.

6. The muzzle attachment device of claim 1 wherein said main body comprises at least two surface openings, wherein at least one surface opening is perpendicular to said longitudinal axis of said main body and one surface opening is at a slant to said longitudinal axis of said main body.

7. The muzzle attachment device of claim 6 wherein at least one said perpendicular surface opening and at least one slanted surface opening are juxtaposed longitudinally on said main body and said perpendicular opening is disposed nearer said cap attachment end than said slanted opening.

8. The muzzle attachment device of claim 1 wherein said main body further comprises tool receiving means for positioning said main body on a muzzle.

9. The muzzle attachment device of claim 8 wherein said tool receiving means comprises wrench flats.

10. The muzzle attachment device of claim 1 wherein said main body to muzzle attachment means comprises means for threadably attaching said main body to an appropriately threaded muzzle, when provided.

11. The muzzle attachment device of claim 1 wherein said main body rotational adjustment means comprises a spur and clip.

12. The muzzle attachment device of claim 1 wherein said main body rotational adjustment means comprises a star washer and lock nut.

13. The muzzle attachment device of claim 1 wherein said main body rotational adjustment means comprises main body locking means for locking said main body into a preselected rotational position on the muzzle of the firearm, when provided.

14. The muzzle attachment device of claim 1 further comprising indicia circumferentially positioned on a user-visible portion of said main body for indicating the rotational position of the main body relative to the muzzle.

15. The muzzle attachment device of claim 14 wherein said indicia includes a mark for adjustment of said main body for a left-handed firer and a mark for adjustment of said main body for a right-handed firer.

16. The muzzle attachment device of claim 1 wherein said cap is substantially cylindrical in shape.

17. The muzzle attachment device of claim 1 wherein said cap comprises a frustum portion facing into said main body, said frustum portion providing flash suppression as well as muzzle stabilization.

18. The muzzle attachment device of claim 17 wherein said frustum portion of said cap is longitudinally positionable to control gas flow out of at least one said surface opening.

19. The muzzle attachment device of claim 1 wherein said cap further comprises an exit opening disposed on said cap adjacent but spaced from said gas-restricting outlet on said cap, said exit opening being positioned to pass a bullet fired from the firearm after it passes through said bullet-passing, gas-restricting outlet.

20. The muzzle attachment device of claim 19 wherein said exit opening is configured to fit a tool whereby said cap may be rotated by a tool fitting said configured exit opening to thereby longitudinally adjust the position of said cap on said main body.

21. The muzzle attachment device of claim 1 further comprising means for retaining said cap at an adjusted position on said main body.

22. The muzzle attachment device of claim 21 wherein said cap retaining means provides a plurality of discrete adjustment positions.

23. The muzzle attachment device of claim 22 wherein said cap retaining means comprises detent engagement, surfaces circumferentially positioned about said cap retaining means, and detent means for engaging said engagement surfaces.

24. The muzzle attachment device of claim 1 further comprising indicia circumferentially positioned on a user-visible portion of said cap for indicating the position of the cap relative to the main body.

25. The muzzle attachment device of claim 24 wherein said cap retaining means comprises detent engagement surfaces circumferentially positioned about said cap retaining means and detent means for engaging said detent engagement surfaces, and said indicia correspond to said detent engagement surfaces.

26. The muzzle attachment device of claim 1 wherein said cap to main body attachment means comprises means for threadably attaching said cap to said main body and wherein said cap position adjustment means comprises means for threadably longitudinally adjusting the position of said cap on said main body.

27. The muzzle attachment device of claim 1 wherein said cap position adjustment means comprises means for longitudinally positioning said cap with reference to said main body to cover at least one said surface opening a preselected amount to thereby control gas ejectment therefrom.

* * * * *